US006803494B1

(12) United States Patent
Ladwig et al.

(10) Patent No.: US 6,803,494 B1
(45) **Date of Patent: *Oct. 12, 2004**

(54) PROCESS FOR SELECTIVELY PRODUCING PROPYLENE IN A FLUID CATALYTIC CRACKING PROCESS

(75) Inventors: Paul K. Ladwig, Randolph, NJ (US); John E. Asplin, Houston, TX (US); Gordon F. Stuntz, Baton Rouge, LA (US); William A. Wachter, Baton Rouge, LA (US); Brian Erik Henry, Katy, TX (US); Shun C. Fung, Bridgewater, NJ (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/574,261

(22) Filed: May 19, 2000

Related U.S. Application Data

(63) Continuation-in-part of application No. 09/073,085, filed on May 5, 1998, now Pat. No. 6,069,287.

(51) Int. Cl.[7] ..... C07C 4/06; C10G 11/00

(52) U.S. Cl. ..... 585/653; 585/648; 585/649; 585/650; 585/651; 208/120.01; 208/72

(58) Field of Search ..... 585/648, 649, 585/650, 651, 653; 208/72, 120.01, 135

(56) References Cited

U.S. PATENT DOCUMENTS

| | | | | |
|---|---|---|---|---|
| 3,442,792 A | | 5/1969 | Eng et al. | 208/62 |
| 3,533,937 A | | 10/1970 | Stankis | 208/62 |
| 3,761,391 A | * | 9/1973 | Conner | 208/74 |
| 3,770,618 A | | 11/1973 | Adams et al. | 208/216 |
| 3,801,494 A | | 4/1974 | Moore et al. | 208/79 |
| 3,893,905 A | * | 7/1975 | Fenske et al. | 208/103 |
| 3,899,543 A | | 8/1975 | Cosyns et al. | 260/667 |
| 3,928,172 A | | 12/1975 | Davis, Jr. et al. | 208/77 |
| 3,957,625 A | | 5/1976 | Orkin | 208/211 |
| 3,959,116 A | | 5/1976 | Arey, Jr. et al. | 208/66 |
| 4,171,257 A | | 10/1979 | O'Rear et al. | 208/120 |
| 4,176,049 A | | 11/1979 | Winter et al. | 208/70 |
| 4,177,136 A | | 12/1979 | Herrington et al. | 208/215 |
| 4,282,085 A | | 8/1981 | O'Rear et al. | 208/120 |
| 4,390,413 A | | 6/1983 | O'Rear et al. | 208/61 |
| 4,502,945 A | | 3/1985 | Olbrich et al. | 208/120 |
| 4,830,728 A | | 5/1989 | Herbst et al. | 208/78 |
| 4,865,718 A | | 9/1989 | Herbst et al. | 208/70 |
| 4,892,643 A | | 1/1990 | Herbst et al. | |
| 4,927,526 A | | 5/1990 | Anderson et al. | 208/152 |
| 4,950,387 A | | 8/1990 | Harandi et al. | 208/49 |
| 4,975,179 A | | 12/1990 | Harandi et al. | 208/66 |
| 5,026,935 A | | 6/1991 | Leyshon et al. | 585/315 |
| 5,026,936 A | | 6/1991 | Leyshon et al. | 585/315 |
| 5,041,208 A | | 8/1991 | Patridge et al. | 208/138 |
| 5,043,522 A | | 8/1991 | Leyshon et al. | 585/651 |
| 5,047,142 A | | 9/1991 | Sherwood, Jr. et al. | 208/251 H |
| 5,069,776 A | | 12/1991 | Biswas et al. | 208/120 |
| 5,143,596 A | | 9/1992 | Maxwell et al. | 208/89 |
| 5,160,424 A | | 11/1992 | Le et al. | 208/67 |
| 5,171,921 A | | 12/1992 | Gaffney et al. | 585/653 |
| 5,220,089 A | | 6/1993 | Le et al. | 585/643 |
| 5,286,373 A | | 2/1994 | Sudhakar et al. | 208/216 |
| 5,292,976 A | | 3/1994 | Dessau et al. | 585/322 |
| 5,346,609 A | | 9/1994 | Fletcher et al. | 208/89 |
| 5,347,061 A | | 9/1994 | Harandi et al. | 585/323 |
| 5,348,928 A | | 9/1994 | Kukes et al. | 502/306 |
| 5,358,633 A | | 10/1994 | Dai et al. | 208/216 R |
| 5,372,704 A | | 12/1994 | Harandi et al. | 208/74 |
| 5,378,352 A | | 1/1995 | Degnan et al. | 208/217 |
| 5,389,232 A | | 2/1995 | Adewuyi et al. | 208/120 |
| 5,396,010 A | | 3/1995 | Harandi et al. | 585/418 |
| 5,409,596 A | | 4/1995 | Fletcher et al. | 208/89 |
| 5,414,172 A | | 5/1995 | Chin et al. | 585/322 |
| 5,468,372 A | | 11/1995 | Seamans et al. | 208/216 R |
| 5,472,594 A | | 12/1995 | Tsang et al. | 208/114 |
| 5,525,211 A | | 6/1996 | Sudhakar et al. | 208/217 |
| 5,576,256 A | | 11/1996 | Monque et al. | 502/61 |

(List continued on next page.)

FOREIGN PATENT DOCUMENTS

| | | | |
|---|---|---|---|
| EP | 0 022 883 B1 | 11/1983 | C10G/69/04 |
| EP | 0 093 475 A1 | 11/1983 | C10G/35/06 |
| EP | 0 109 060 B1 | 3/1987 | C07C/11/06 |
| EP | 0 235 416 B1 | 2/1991 | C10G/35/095 |
| EP | 0 420 326 B1 | 2/1995 | C10G/35/095 |
| EP | 0 557 527 B1 | 2/1996 | C10G/35/095 |
| EP | 0347003 B1 | 5/1996 | C10G/11/05 |
| EP | 849347 | 6/1998 | |
| EP | 0 921 179 A1 | 6/1999 | C10G/11/05 |
| EP | 0 921 181 A1 | 6/1999 | C10G/11/05 |
| WO | 93/22400 | 11/1993 | |
| WO | WO 98/53030 A1 | 11/1998 | C10G/69/08 |
| WO | WO98/56874 | 12/1998 | C10G/11/00 |
| WO | 99/57086 | 11/1999 | |
| WO | WO 01/04237 A2 | 1/2001 | C10G/11/00 |

OTHER PUBLICATIONS

Abstract, Elvers B. et al., "Ullmann's Encycl. Industrial Chemistry", 1992, Vch Verlag, Weinheim, DE, vol. A21, pp. 518–519, paragraph 2.1.1, "*Propene*" (XP002174091).

Abstract, Moore, E.P., "*Monomer Supply*", Polypropylene Handbook, 1996, Hanser Publ., Munich, DE, pp. 262–264, paragraph 7.1.4, (XP002174092).

Derouane et al., "*Synthesis and Characterization of ZSM–5 Type Zeolites*", Applied Catalysis, vol. 1, pp. 201–224, (1981).

(List continued on next page.)

*Primary Examiner*—Walter D. Griffin

(57) ABSTRACT

A process for producing polypropylene from olefins selectively produced from a catalytically cracked or thermally cracked naphtha stream is disclosed herein. The naphtha stream is contacted with a catalyst containing from about 10 to 50 wt. % of a crystalline zeolite having an average pore diameter less than about 0.7 nanometers at reaction conditions which include temperatures from about 500° C. to 650° C. and a hydrocarbon partial pressure from about 10 to 40 psia. The catalyst may be pre-coked with a carbonaceous feed. Alternatively, the carbonaceous feed used to coke the catalyst may be co-fed with the naphtha feed.

19 Claims, No Drawings

U.S. PATENT DOCUMENTS

| | | | | | |
|---|---|---|---|---|---|
| 5,643,441 | A | | 7/1997 | Timken et al. | 208/89 |
| 5,665,949 | A | * | 9/1997 | Fusco et al. | 208/161 |
| 5,730,859 | A | * | 3/1998 | Johnson et al. | 208/78 |
| 5,770,047 | A | | 6/1998 | Salazar et al. | 208/254 R |
| 5,846,403 | A | | 12/1998 | Swan et al. | 208/113 |
| 5,865,987 | A | | 2/1999 | Borghard et al. | 208/97 |
| 5,865,988 | A | | 2/1999 | Collins et al. | 208/97 |
| 5,951,963 | A | | 9/1999 | He et al. | 423/713 |
| 5,985,136 | A | | 11/1999 | Brignac et al. | 208/216 R |
| 5,997,728 | A | | 12/1999 | Adewuyi et al. | 208/120.01 |
| 6,069,287 | A | * | 5/2000 | Ladwig et al. | 585/648 |
| 6,093,867 | A | * | 7/2000 | Ladwig et al. | 585/648 |
| 6,106,697 | A | * | 8/2000 | Swan et al. | 208/77 |
| 6,118,035 | A | * | 9/2000 | Fung et al. | 585/653 |
| 6,126,812 | A | | 10/2000 | Drake et al. | 208/134 |
| 6,126,814 | A | | 10/2000 | Lapinski et al. | 208/217 |
| 6,258,257 | B1 | * | 7/2001 | Swan, III et al. | 208/74 |
| 6,258,990 | B1 | * | 7/2001 | Fung et al. | 585/330 |
| 6,388,152 | B1 | | 5/2002 | Ladwig et al. | 585/330 |

OTHER PUBLICATIONS

Fleisch et al., "*Hydrothermal Dealumination of Faujasites*", Journal of Catalysis, vol. 99, pp. 117–125 (1986).

Gross et al., "*Surface composition of dealuminated Y zeolites studied by X–ray photoelectron spectroscopy*", Zeolites, vol. 4, No. 1, pp. 25–29, (Jan., 1984).

Hsing, L.H. et al., "*Cracking of FC and Coker Naphthas by ZSM–5 Catalyst and Equilibrium FC Catalyst*", Preprints, vol. 39, No. 3, Jul. 1994, pp. 388–392 (XP000984372) American Chemical Society, Washington, DC.

Jacobs et al., "*Framework Hydroxyl Groups of H–ZSM–5 Zeolites*", J. Phys. Chem., vol. 86, pp. 3050–3052 (1982).

Derouane et al., "*Concerning the Aluminum Distribution Gradient in ZSM–5 Zeolites*", Journal of Catalysis, vol. 71, pp. 447–448, (1981).

Kung, "*Intrinsic activities and pore diffusion effect in hydrocarbon cracking in steamed Y zeolite*", Studies in Surfac-e.Science and Catalysis, vol. 122, pp. 23–33, (1999, Elsevier).

Meyers et al., "*A Multitechnique Characterization of Dealuminated Mordenites*", Journal of Catalysis, vol. 110, pp. 82–95 (1988).

Von Ballmoos et al., "*Three–Dimensional Mapping of the Zoned Aluminum Distribution in ZSM–5*", Proceedings of the Sixth International Zeolite Conference, Reno, NV, Jul. 10–15, 1983, published by Butterworths & Co., Guildford, Engl., pp. 803–811, (1984).

* cited by examiner

PROCESS FOR SELECTIVELY PRODUCING PROPYLENE IN A FLUID CATALYTIC CRACKING PROCESS

CROSS-REFERENCE TO RELATED APPLICATION

This is a continuation-in-part of U.S. patent application Ser. No. 09/073,085, filed May 5, 1998, now U.S. Pat. No. 6,069,287.

FIELD OF THE INVENTION

The present invention relates to a process for producing polypropylene from $C_3$ olefins selectively produced from a catalytically cracked or thermally cracked naphtha stream.

BACKGROUND OF THE INVENTION

The need for low-emissions fuels has created an increased demand for light olefins used use in alkylation, oligomerization, MTBE, and ETBE synthesis processes. In addition, a low cost supply of light olefins, particularly propylene, continues to be in demand to serve as feed for polyolefins production, particularly polypropylene production.

Fixed bed processes for light paraffin dehydrogenation have recently attracted renewed interest for increasing olefins production. However, these types of processes typically require relatively large capital investments as well as high operating costs. It is therefore advantageous to increase olefins yield using processes, which require relatively small capital investment. It would be particularly advantageous to increase olefins yield in catalytic cracking processes.

A problem inherent in producing olefins products using FCC units is that the process depends on a specific catalyst balance to maximize production of light olefins while also achieving high conversion of the 650° F.+(~340° C.+) feed components. In addition, even if a specific catalyst balance can be maintained to maximize overall olefins production, olefins selectivity is generally low because of undesirable side reactions, such as extensive cracking, isomerization, aromatization and hydrogen transfer reactions. Light saturated gases produced from undesirable side reactions result in increased costs to recover the desirable light olefins. Therefore, it is desirable to maximize olefins production in a process that allows a high degree of control over the selectivity to $C_2$–$C_4$ olefins that are processed and polymerized to form products such as polypropylene and polyethylene.

SUMMARY OF THE INVENTION

An embodiment of the present invention comprises a process for producing polypropylene comprising the steps of (a) contacting a catalyst with a carbonaceous material to pre-coke the catalyst and then (b) contacting a naphtha feed containing between about 10 and about 30 wt. % paraffins and between about 15 and about 70 wt. % olefins with the pre-coked catalyst to form a cracked product, the catalyst comprising about 10 to about 50 wt. % of a crystalline zeolite having an average pore diameter less than about 0.7 nm, the reaction conditions including a temperature from about 500° to 650° C., a hydrocarbon partial pressure of 10 to 40 psia (70–280 kPa), a hydrocarbon residence time of 1 to 10 seconds, and a catalyst to feed ratio, by weight, of about 4 to 10, wherein no more than about 20 wt. % of paraffins are converted to olefins and wherein propylene comprises at least 90 mol. % of the total $C_3$ products; and, (c) separating the propylene from the cracked product and polymerizing the propylene to form polypropylene.

In another preferred embodiment of the present invention the catalyst is a ZSM-5 type catalyst.

In still another preferred embodiment of the present invention the feed contains about 10 to 30 wt. % paraffins, and from about 20 to 70 wt. % olefins.

In yet another preferred embodiment of the present invention the reaction zone is operated at a temperature from about 525° C. to about 600° C.

DETAILED DESCRIPTION OF THE INVENTION

Suitable hydrocarbons feeds for producing the relatively high $C_2$, $C_3$, and $C_4$ olefins yields are those streams boiling in the naphtha range and containing from about 5 wt. % to about 35 wt. %, preferably from about 10 wt. % to about 30 wt. %, and more preferably from about 10 to 25 wt. % paraffins, and from about 15 wt. %, preferably from about 20 wt. % to about 70 wt. % olefins. The feed may also contain naphthenes and aromatics. Naphtha boiling range streams are typically those having a boiling range from about 65° F. to about 430° F. (18–225° C.), preferably from about 65° F. to about 300° F. (18–150° C.).

The naphtha feed can be a thermally-cracked or catalytically-cracked naphtha derived from any appropriate source, including fluid catalytic cracking (FCC) of gas oils and resids or delayed- or fluid-coking of resids. Preferably, the naphtha streams used in the present invention derive from the fluid catalytic cracking of gas oils and resids because the product naphthas are typically rich in olefins and/or diolefins and relatively lean in paraffins.

The process of the present invention is performed in a process unit comprising a reaction zone, a stripping zone, a catalyst regeneration zone, and a fractionation zone. The naphtha feed is fed into the reaction zone where it contacts a source of hot, regenerated catalyst. The hot catalyst vaporizes and cracks the feed at a temperature from about 500° C. to 650° C., preferably from about 525° C. to 600° C. The cracking reaction deposits coke on the catalyst, thereby deactivating the catalyst. The cracked products are separated from the coked catalyst and sent to a fractionator. The coked catalyst is passed through the stripping zone where volatiles are stripped from the catalyst particles with steam. The stripping can be preformed under low severity conditions to retain a greater fraction of adsorbed hydrocarbons for heat balance. The stripped catalyst is then passed to the regeneration zone where it is regenerated by burning coke on the catalyst in the presence of an oxygen containing gas, preferably air. Decoking restores catalyst activity and simultaneously heats the catalyst to between about 650° C. and about 750° C. The hot catalyst is then recycled to the reaction zone to react with fresh naphtha feed. Flue gas formed by burning coke in the regenerator may be treated for removal of particulates and for conversion of carbon monoxide. The cracked products from the reaction zone are sent to a fractionation zone where various products are recovered, particularly a $C_3$ fraction and a $C_4$ fraction.

In another embodiment of the present invention, the catalyst may be pre-coked before contacting the naphtha feed. Pre-coking of the catalyst improves selectivity to propylene. The catalyst can be pre-coked by injecting a coke-producing carbonaceous feed upstream from the point at which the naphtha feed contacts the catalyst. Alternatively, the pre-coking stream can be co-fed with the naphtha feed. Suitable carbonaceous feeds used to pre-coke the catalyst can include, but are not limited to, light cat cycle oil, heavy cat cycle oil, cat slurry bottoms or other heavy, coke producing feeds having a boiling point greater than about 180° C., more preferably between about 180° C. and about 540° C., more preferably between about 200° C. and about 480° C., and more preferably between about 315° C. and about 480° C. An added benefit is that delta coke is increased, which provides additional heat in the regenerator needed to heat balance the process.

While attempts have been made to increase light olefins yields in the FCC process unit itself, the practice of the present invention uses its own distinct process unit, as previously described, which receives naphtha from a suitable source in the refinery. The reaction zone is operated at process conditions that will maximize $C_2$ to $C_4$ olefins, particularly propylene, selectivity with relatively high conversion of $C_5$+ olefins. Catalysts suitable for use in the practice of the present invention are those which are comprising a crystalline zeolite having an average pore diameter less than about 0.7 nanometers (nm), said crystalline zeolite comprising from about 10 wt. % to about 50 wt. % of the total fluidized catalyst composition. It is preferred that the crystalline zeolite be selected from the family of medium-pore-size (<0.7 nm) crystalline aluminosilicates, otherwise referred to as zeolites. Of particular interest are the medium-pore zeolites with a silica to alumina molar ratio of less than about 75:1, preferably less than about 50:1, and more preferably less than about 40:1, although some embodiments incorporate silica-to-alumina ratios greater than 40:1. The pore diameter, also referred to as effective pore diameter, is measured using standard adsorption techniques and hydrocarbonaceous compounds of known minimum kinetic diameters. See Breck, *Zeolite Molecular Sieves*, 1974 and Anderson et al., J. Catalysis 58, 114 (1979), both of which are incorporated herein by reference.

Medium-pore-size zeolites that can be used in the practice of the present invention are described in "Atlas of Zeolite Structure Types," eds. W. H. Meier and D. H. Olson, Butterworth-Heineman, Third Edition, 1992, which is hereby incorporated by reference. The medium-pore-size zeolites generally have a pore size from about 0.5 nm, to about 0.7 nm and include for example, MFI, MFS, MEL, MTW, EUO, MTT, HEU, FER, and TON structure type zeolites (IUPAC Commission of Zeolite Nomenclature). Non-limiting examples of such medium-pore-size zeolites, include ZSM-5, ZSM-12, ZSM-22, ZSM-23, ZSM-34, ZSM-35, ZSM-38, ZSM-48, ZSM-50, silicalite, and silicalite 2. The most preferred is ZSM-5, which is described in U.S. Pat. Nos. 3,702,886 and 3,770,614. ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. All of the above patents are incorporated herein by reference. Other suitable medium-pore-size zeolites include the silicoaluminophosphates (SAPO), such as SAPO-4 and SAPO-11 which is described in U.S. Pat. No. 4,440,871; chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651; and iron aluminosilicates.

The medium-pore-size zeolites can include "crystalline admixtures" which are thought to be the result of faults occurring within the crystal or crystalline area during the synthesis of the zeolites. Examples of crystalline admixtures of ZSM-5 and ZSM-11 are disclosed in U.S. Pat. No. 4,229,424, which is incorporated herein by reference. The crystalline admixtures are themselves medium-pore-size zeolites and are not to be confused with physical admixtures of zeolites in which distinct crystals of crystallites of different zeolites are physically present in the same catalyst composite or hydrothermal reaction mixtures.

The catalysts of the present invention are held together with an inorganic oxide matrix material component. The inorganic oxide matrix component binds the catalyst components together so that the catalyst product is hard enough to survive interparticle and reactor wall collisions. The inorganic oxide matrix can be made from an inorganic oxide sol or gel which is dried to "bind" the catalyst components together. Preferably, the inorganic oxide matrix is not catalytically active and will be comprising oxides of silicon and aluminum. Preferably, separate alumina phases are incorporated into the inorganic oxide matrix. Species of aluminum oxyhydroxides-γ-alumina, boehmite, diaspore, and transitional aluminas such as α-alumina, β-alumina, γ-alumina, δ-alumina, ϵ-alumina, κ-alumina, and ρ-alumina can be employed. Preferably, the alumina species is an aluminum trihydroxide such as gibbsite, bayerite, nordstrandite, ordoyelite. The matrix material may also contain phosphorous or aluminum phosphate.

Process conditions include temperatures from about 500° C. to about 650° C., preferably from about 525° C. to 600° C., hydrocarbon partial pressures from about 10 to 40 psia (70–280 kPa), preferably from about 20 to 35 psia (140–245 kPa); and a catalyst to naphtha (wt/wt) ratio from about 3 to 12, preferably from about 4 to 10, where catalyst weight is total weight of the catalyst composite. Preferably, steam is concurrently introduced with the naphtha stream into the reaction zone and comprises up to about 50 wt. % of the hydrocarbon feed. Also, it is preferred that the feed residence time in the reaction zone be less than about 10 seconds, for example from about 1 to 10 seconds. These conditions will be such that at least about 60 wt. % of the $C_5$+ olefins in the naphtha stream are converted to $C_4$− products and less than about 25 wt. %, preferably less than about 20 wt. % of the paraffins are converted to $C_4$− products, and that propylene comprises at least about 90 mol. %, preferably greater than about 95 mol. % of the total $C_3$ reaction products with the weight ratio of propylene/total $C_2$-products greater than about 3.5.

Preferably, ethylene comprises at least about 90 mol. % of the $C_2$ products, with the weight ratio of propylene:ethylene being greater than about 4, and that the "full range" $C_5$+ naphtha product is enhanced in both motor and research octanes relative to the naphtha feed. It is also within the scope of this invention to feed an effective amount of single ring aromatics to the reaction zone to also improve the selectivity of propylene versus ethylene. The aromatics may be from an external source such as a reforming process unit or they may consist of heavy naphtha recycle product from the instant process.

The following examples are presented for illustrative purposes only and are not to be taken as limiting the present invention in any way.

EXAMPLES 1–13

The following examples illustrate the criticality of process operating conditions for maintaining chemical grade propylene purity with samples of cat naphtha cracked over ZCAT-40 (a catalyst that contains ZSM-5) which had been steamed at 1500° F. (815° C.) for 16 hrs to simulate commercial equilibrium. Comparison of Examples 1 and 2 show that increasing Cat/Oil ratio improves propylene yield, but sacrifices propylene purity. Comparison of Examples 3 and 4 and 5 and 6 shows reducing oil partial pressure greatly improves propylene purity without compromising propylene yield. Comparison of Examples 7 and 8 and 9 and 10 shows increasing temperature improves both propylene yield and purity. Comparison of Examples 11 and 12 shows decreasing cat residence time improves propylene yield and purity. Example 13 shows an example where both high propylene yield and purity are obtained at a reactor temperature and cat/oil ratio that can be achieved using a conventional FCC reactor/regenerator design for the second stage.

TABLE 1

| Example | Feed Olefins, wt % | Temp. ° C. | Cat/Oil | Oil psia | Oil Res. Time, sec | Cat Res. Time, sec | Wt. % $C_3^=$ | Wt. % $C_3^+$ | Propylene Purity, % |
|---|---|---|---|---|---|---|---|---|---|
| 1 | 38.6 | 566 | 4.2 | 36 | 0.5 | 4.3 | 11.4 | 0.5 | 95.8% |
| 2 | 38.6 | 569 | 8.4 | 32 | 0.6 | 4.7 | 12.8 | 0.8 | 94.1% |
| 3 | 22.2 | 510 | 8.8 | 18 | 1.2 | 8.6 | 8.2 | 1.1 | 88.2% |
| 4 | 22.2 | 511 | 9.3 | 38 | 1.2 | 5.6 | 6.3 | 1.9 | 76.8% |
| 5 | 38.6 | 632 | 16.6 | 20 | 1.7 | 9.8 | 16.7 | 1.0 | 94.4% |
| 6 | 38.6 | 630 | 16.6 | 13 | 1.3 | 7.5 | 16.8 | 0.6 | 96.6% |
| 7 | 22.2 | 571 | 5.3 | 27 | 0.4 | 0.3 | 6.0 | 0.2 | 96.8% |
| 8 | 22.2 | 586 | 5.1 | 27 | 0.3 | 0.3 | 7.3 | 0.2 | 97.3% |
| 9 | 22.2 | 511 | 9.3 | 38 | 1.2 | 5.6 | 6.3 | 1.9 | 76.8% |
| 10 | 22.2 | 607 | 9.2 | 37 | 1.2 | 6.0 | 10.4 | 2.2 | 82.5% |
| 11 | 22.2 | 576 | 18.0 | 32 | 1.0 | 9.0 | 9.6 | 4.0 | 70.6% |
| 12 | 22.2 | 574 | 18.3 | 32 | 1.0 | 2.4 | 10.1 | 1.9 | 84.2% |
| 13 | 38.6 | 606 | 8.5 | 22 | 1.0 | 7.4 | 15.0 | 0.7 | 95.5% |

| Example | Wt. % $C_2^=$ | Wt. % $C_2^+$ | Ratio of $C_3^=$ to $C_2^=$ | Ratio of $C_3^=$ to $C_2^-$ | Wt. % $C_3^=$ |
|---|---|---|---|---|---|
| 1 | 2.35 | 2.73 | 4.9 | 4.2 | 11.4 |
| 2 | 3.02 | 3.58 | 4.2 | 3.6 | 12.8 |
| 3 | 2.32 | 2.53 | 3.5 | 3.2 | 8.2 |
| 4 | 2.16 | 2.46 | 2.9 | 2.6 | 6.3 |
| 5 | 6.97 | 9.95 | 2.4 | 1.7 | 16.7 |
| 6 | 6.21 | 8.71 | 2.7 | 1.9 | 16.8 |
| 7 | 1.03 | 1.64 | 5.8 | 3.7 | 6.0 |
| 8 | 1.48 | 2.02 | 4.9 | 3.6 | 7.3 |
| 9 | 2.16 | 2.46 | 2.9 | 2.6 | 6.3 |
| 10 | 5.21 | 6.74 | 2.0 | 1.5 | 10.4 |
| 11 | 4.99 | 6.67 | 1.9 | 1.4 | 9.6 |
| 12 | 4.43 | 6.27 | 2.3 | 1.6 | 10.1 |
| 13 | 4.45 | 5.76 | 3.3 | 2.6 | 15.0 |

$C_2^- = CH_4 + C_2H_4 + C_2H_6$

The above examples (1,2,7 and 8) show that $C_3^=/C_2^=>4$ and $C_3^=/C_2^->3.5$ can be achieved by selection of suitable reactor conditions.

EXAMPLES 14–17

The cracking of olefins and paraffins contained in naphtha streams (e.g., FCC naphtha, coker naphtha) over small or medium-pore zeolites such as ZSM-5 can produce significant amounts of ethylene and propylene. The selectivity to ethylene or propylene, and selectivity of propylene to propane varies as a function of catalyst and process operating conditions. It has been found that propylene yield can be increased by co-feeding steam along with cat naphtha to the reactor. The catalyst may be ZSM-5 or other small or medium-pore zeolites. Table 2 below illustrates the increase in propylene yield when 5 wt. % steam is co-fed with an FCC naphtha containing 38.8 wt % olefins. Although propylene yield increased, the propylene purity is diminished. Thus, other operating conditions may need to be adjusted to maintain the targeted propylene selectivity.

TABLE 2

| Example | Steam Co-feed | Temp. C. | Cat/Oil | Oil psia | Oil Res. Time, sec | Cat Res. Time, sec | Wt % Propylene | Wt % Propane | Propylene Purity, % |
|---|---|---|---|---|---|---|---|---|---|
| 14 | No | 630 | 8.7 | 18 | 0.8 | 8.0 | 11.7 | 0.3 | 97.5% |
| 15 | Yes | 631 | 8.8 | 22 | 1.2 | 6.0 | 13.9 | 0.6 | 95.9% |
| 16 | No | 631 | 8.7 | 18 | 0.8 | 7.8 | 13.6 | 0.4 | 97.1% |
| 17 | Yes | 632 | 8.4 | 22 | 1.1 | 6.1 | 14.6 | 0.8 | 94.8% |

EXAMPLES 18–20

A light cat naphtha (boiling point less than about 140° C.) was cracked in a fixed bed Z-CAT 40 (which had been steamed at 816° C. for 15 hours) at 1100° F. (593° F.), 12 psig and a weight hourly space velocity of 1.2. Steam was co-fed with the light cat naphtha at a ratio of 1:1. The starting catalyst was free of coke and yields were determined as a function of time on stream as coke built up on the catalyst. Table 3 illustrates that selectivity to propylene versus propane and ethylene and the selectivity to propylene in the $C_3$ fraction improves as coke accumulates on the catalyst.

TABLE 3

| Example | 18 | 19 | 20 |
|---|---|---|---|
| Time (hr) | 0 | 60 | 150 |
| $C_3^=$ wt % | 25 | 23 | 21 |
| $C_2^=$ wt % | 14 | 10 | 6 |
| $C_3^=/C_2^=$ | 1.8 | 2.3 | 3.5 |
| Propylene in $C_3$ fraction (wt %) | 91 | 94.5 | 98 |

Light olefins resulting from the preferred process may be used as feeds for processes such as oligomerization, polymerization, co-polymerization, terpolymerization, and related processes (hereinafter "polymerization") to form macromolecules. Such light olefins may be polymerized both alone and in combination with other species, in accordance with polymerization methods known in the art. In some cases it may be desirable to separate, concentrate, purify, upgrade, or otherwise process the light olefins prior to polymerization. Propylene and ethylene are preferred polymerization feeds. Polypropylene and polyethylene are preferred polymerization products made therefrom.

What is claimed is:

1. A process for producing propylene in a reactor comprising a first zone positioned upstream from a second zone comprising the steps of:

(a) in said first zone, contacting a carbonaceous feed having a boiling point greater than about 180° C. with a catalyst comprising a crystalline zeolite having an average pore diameter less than about 0.7 nm, thereby forming a pre-coked catalyst; and, (b) in said second zone, contacting a naphtha feed containing between about 10 and about 30 wt. % paraffins and between about 15 and about 70 wt. % olefins with said pre-coked catalyst to form a cracked product, the reaction conditions including a temperature from about 500° C. to 650° C., a hydrocarbon partial pressure of 10 to 40 psia, a hydrocarbon residence time of 1 to 10 seconds, and a catalyst to feed ratio, by weight, of about 4 to 10, wherein no more than about 20 wt. % of paraffins are converted to olefins and wherein propylene comprises at least 90 mol. % of the total $C_3$ products.

2. The process of claim 1 wherein the crystalline zeolite is selected from the ZSM series.

3. The process of claim 2 wherein the crystalline zeolite is ZSM-5.

4. The process of claim 3 wherein propylene comprises at least 95 mol. % of the total $C_3$ products.

5. The process of claim 3 wherein the reaction temperature is from about 500° C. to about 600° C.

6. The process of claim 3 wherein at least about 60 wt. % of the $C_5$+ olefins in the feed are converted to $C_4$− products and less than about 25 wt. % of the paraffins are converted to $C_4$− products.

7. The process of claim 6 wherein propylene comprises at least about 90 mol. % of the total $C_3$ products.

8. The process of claim 7 wherein the weight ratio of propylene to total $C_2$− products is greater than about 3.5.

9. The process of claim 8 wherein the weight ratio of propylene to total $C_2$− products is greater than about 4.0.

10. The process according to claim 1 further comprising the step of separating the propylene from the cracked product and polymerizing the propylene to form polypropylene.

11. A process for producing propylene comprising the steps of:

contacting (i) a naphtha feed containing between about 10 and about 30 wt. % paraffins and between about 15 and about 70 wt. % olefins, and (ii) a carbonaceous feed having a boiling point greater than about with a catalyst to form a cracked product, the catalyst comprising a crystalline zeolite having an average pore diameter less than about 0.7 nm, the reaction conditions including a temperature from about 500° C. to 650° C., a hydrocarbon partial pressure of 10 to 40 psia, a hydrocarbon residence time of 1 to 10 seconds, and a catalyst to feed ratio, by weight, of about 4 to 10, wherein no more than about 20 wt. % of paraffins are converted to olefins and wherein propylene comprises at least 90 mol. % of the total $C_3$ products.

12. The process of claim 11 wherein the crystalline zeolite is selected from the ZSM series.

13. The process of claim 12 wherein the crystalline zeolite is ZSM-5.

14. The process of claim 11 wherein propylene comprises at least 95 mol. % of the total $C_3$ products.

15. The process of claim 13 wherein the reaction temperature is from about 500° C. to about 600° C.

16. The process of claim 15 wherein at least about 60 wt. % of the $C_5$+ olefins in the feed is converted to $C_4$− products and less than about 25 wt. % of the paraffins are converted to $C_4$− products.

17. The process of claim 16 wherein the weight ratio of propylene to total $C_2$− products is greater than about 3.5.

18. The process of claim 17 wherein the weight ratio of propylene to total $C_2$− products is greater than about 4.0.

19. The process of claim 11 further comprising the step of separating the propylene from the cracked product and polymerizing the propylene to form polypropylene.

* * * * *